United States Patent [19]

Mori et al.

[11] Patent Number: 4,557,765

[45] Date of Patent: Dec. 10, 1985

[54] METHOD FOR AMORPHIZATION OF A METAL CRYSTAL

[75] Inventors: Hirotaro Mori, Suita; Hiroshi Fujita, Ibaraki, both of Japan

[73] Assignee: Osaka University, Suita, Japan

[21] Appl. No.: 585,911

[22] Filed: Mar. 2, 1984

[30] Foreign Application Priority Data

Jul. 16, 1983 [JP] Japan ..... 58-128710

[51] Int. Cl.[4] ..... C22F 3/00

[52] U.S. Cl. ..... 148/4; 148/403

[58] Field of Search ..... 148/403, 4, 3, 1, 13; 219/121 EB, 121 EF, 121 EG; 156/DIG. 102

[56] References Cited

U.S. PATENT DOCUMENTS 3,926,682 12/1975 Shimada et al. ..... 148/4

4,122,240 10/1978 Banas et al. ..... 148/3

OTHER PUBLICATIONS

"Properties and Applications of Ion Implanted Alloys," Myers, Journal of Vacuum Science and Technology, vol. 17, No. 1, Jan.-Feb. 80.

*Primary Examiner*—L. Dewayne Rutledge
*Assistant Examiner*—S. Kastler
*Attorney, Agent, or Firm*—Spencer & Frank

[57] ABSTRACT

A desired shape of amorphous region is formed at a predetermined position in a metal crystal by introducing the desired shape of lattice defect at the predetermined position in the metal crystal, and then irradiating the lattice defect with an electron beam to form the desired shape of amorphous region at the predetermined position in the metal crystal.

5 Claims, 2 Drawing Figures

METHOD FOR AMORPHIZATION OF A METAL CRYSTAL

BACKGROUND OF THE INVENTION

1. Field of the Invention:

The present invention relates to a method of amorphization of a metal crystal.

2. Description of the Prior Art:

Amorphous metals have recently attracted interest in a broad industrial field because of their unique physical properties.

The inventors have found a method for transforming a given metal into an amorphous metal by irradiating the given metal with an electron beam accelerated with a higher voltage than a "threshold voltage" which damages (meaning to disturb the arrangement of the atoms forming the metal crystal) the given metal, as described in copending patent application Ser. No. 06/585,912 filed Mar. 2, 1984. However, in this method, the formation of the amorphous metal always starts from the vicinity of a surface of the crystal, so that it is impossible to attain the amorphization at an arbitrary position in the interior of the crystal distant from the surface. Further the shape of the amorphous region in the crystal is always limited to a rod shape or a block shape, one end of which is positioned at the surface of the metal crystal. Such a limitation of the shape becomes a great hindrance in obtaining a given function with the resulting amorphous-crystal composite material.

SUMMARY OF THE INVENTION

An object of the present invention is to form an amorphous metal region having a given shape at a predetermined position in a metal crystal.

The present invention lies in a method of obtaining the amorphization of a metal crystal, which comprises introducing a given shape of lattice defect at a predetermined position in a given metal crystal and then irradiating such a metal crystal with an electron beam to form an amorphous region of given shape at the predetermined position in the metal crystal.

As the metal crystal, use may be made of intermetallic compounds selected from the group consisting of NiTi and $Co_2Ti$. Of the two, NiTi is available at a relatively low cost and can be used at a higher temperature, so it is preferable.

The lattice defect is preferably introduced in the form of a dislocation line, a stacking fault, a crystal grain boundary, a foreign phase interface or the like, because the amorphization of a metal crystal owing to the irradiation with the electron beam is caused preferentially at the position of a lattice defect, such as the dislocation line, stacking fault, crystal grain boundary, various foreign phase interfaces or the like.

According to the method of the present invention, composite materials of a desired form of amorphous metal and a base metal crystal can be obtained.

DESCRIPTION OF THE PREFERRED EMBODIMENTS

Figure 1:
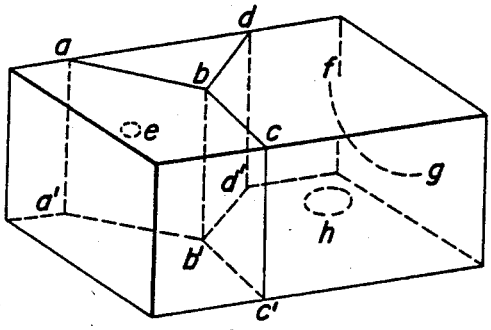
FIG. 1 is a schematic perspective view showing a given metal crystal to which crystal grain boundaries (a-b-b'-a', b-c-c'-b' and b-d-d'-b'), a small dislocation loop (e), a dislocation line (f-g) or a large dislocation loop (h) have been artificially introduced prior to the irradiation.
Figure 2:
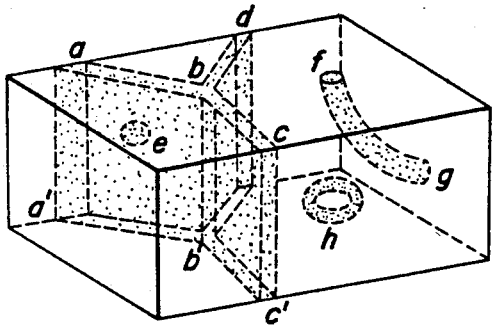
FIG. 2 is a schematic perspective view showing the metal crystal after the irradiation with an electron beam, which shows plate-formed amorphous regions formed along the grain boundaries (a-b-b'-a', b-c-c'-b' and b-d-d'-b'), a spherical amorphous region formed along a small dislocation loop, a cylindrical amorphous region formed along a dislocation line (f-g) and a ring-formed amorphous region formed along a large dislocation loop (h).

As shown in FIG. 1, lattice defects, such as crystal grain boundaries (a-b-b'-a', b-c-c'-b' and b-d-d'-b'), a small dislocation loop (e), a large dislocation loop (h) or the like are arranged at a predetermined position in a given crystal through plastic deformation, heat treatment, irradiation with a particle ray or the like. Then, such a crystal is irradiated with an accelerated electron beam having energy enough to damage the crystal. The irradiation is performed by keeping the electron beam flux density at a value not exceeding $1\times10^{24}$ c/m$^2$. sec determined according to each crystal and controlling the irradiating temperature at a temperature not exceeding 273° K. for a time not exceeding 1300 seconds determined according to the given crystal and the electron beam flux. By irradiating under such a condition, the vacancy introduced due to the damage caused by the irradiation is gradually accumulated in the interior of the crystal but the concentration of the vacancy is locally noticeably increased at the position in the vicinity of the previously introduced lattice defect, and therefore the amorphous phase is preferentially formed at such a position. FIG. 2 shows the thus formed amorphous phases and at each of the above described defects, the plate-formed (a-b-b'-a', b-c-c'-b' and b-d-d'-b'), rod-formed (f-g), spherical (e), or ring-formed (h), an amorphous region is respectively formed. Among these regions, the plate-formed or ring-formed, or curved rod-formed amorphous region may be formed from a defect referred to as a sub-boundary or cell wall in which the dislocation lines are arranged in a group. The thickness of each amorphous region in FIG. 2 can be freely controlled by adjusting the dose of the electron beam irradiation. Embodiments of the irradiating condition necessary for the formation of the amorphous phase along such a lattice defect are shown in the following examples.

The invention will be explained with reference to the following examples but is not limited thereto.

EXAMPLE 1

A NiTi metal crystal was rolled at room temperature to introduce a lattice defect of dislocation in said metal crystal and then the rolled metal crystal was irradiated with an electron beam at an acceleration voltage of 2 MV, an electron beam flux density of $7\times10^{23}$ e/m$^2$. sec and a temperature of 255–273 K for 1,300 seconds to cause amorphization along the above described lattice defect.

EXAMPLE 2

An ingot of $Co_2Ti$ produced through an arc-melting process was annealed at 1,273 K for 160 KS to introduce a lattice defect of grain boundary and then irradiated with an electron beam at an acceleration voltage of 2 MV, an electron beam flux density of $1\times10^{24}$ e/m$^2$. sec and a temperature of 160 K for 120 seconds to cause amorphization along the above described lattice defect.

EXAMPLE 3

A NiTi metal crystal rolled at room temperature was annealed at 1,173 K for 12 KS to introduce a lattice defect of grain boundary and then irradiated with an electron beam at an acceleration voltage of 2 MV, an electron beam flux density of $7\times10^{23}$ e/m$^2$. seconds to and a temperature of 260 K for 1,300 sec to cause amorphization along the above described lattice defect.

The method of the present invention utilizes a phenomenon that the amorphous phase formed by the irradiation of an electron beam is formed only along a linear or plane lattice defect in the crystal under a certain irradiating condition and according to this method, a desired form of amorphous region may be formed at a predetermined position in the crystal by adjusting the arrangement of these lattice defects. In these lattice defects which act as a nucleus for formation of these amorphous phases, the dislocation may be a loop having a diameter of several μm or may be arranged in a minimum distance of several μm. Accordingly, when this is used as the nucleus, a very fine spherical amorphous phase having a diameter of several μm may be formed or cylindrical amorphous phases having the same diameter may be distributed in a distance of several μm or more. Furthermore, the crystal grain boundary or foreign phase interface may be arranged in a distance of several tens μm in the minimum and when these defects are served as the nucleus, a plate-formed or a curved rod-formed amorphous region may be formed in a distance of several tens μm or more in the crystal. Moreover, when these various lattice defects are used in a combination, amorphous regions having substantially desired shapes may be formed in the crystal.

This is a unique characteristic of the method of the present invention, which has never been attained in the prior method for producing amorphous metals. In addition, the method of the present invention have the following advantages, that is (1) the thickness (or diameter) of each amorphous region may be optionally controlled by adjusting the dose of electron beam irradiated, and (2) there is no variation in the alloy composition, so that the junction of the amorphous region to the base metal is very high. These two advantages have never been attained by prior methods.

What is claimed is:

1. A method of forming an amorphous metal region at a predetermined position within an intermetallic compound comprising the steps of:

(a) introducing a lattice defect having a given shape at said predetermined position within said intermetallic compound by adjusting the arrangement of the lattice defects, said defect being selected from the group consisting of a dislocation line, stacking fault, crystal grain boundary and foreign interface;

(b) irradiating said intermetallic compound with an electron beam having a flux density not exceeding approximately $1\times10^{24}$ e/m$^2$. sec, the energy of said electron beam being sufficient to introduce damage to said intermetallic compound, particularly in the vicinity of said lattice defect, in addition to that produced in step (a);

(c) heating said intermetallic compound to a temperature not exceeding approximately 273° K.; and (d) maintain said electron beam irradiation for a time not exceeding approximately 1300 seconds to cause amorphorization along said lattice defect, said intermetallic compound being selected from the group consisting of NiTi and $Co_2Ti$.

2. The method as claimed in claim 1, wherein the intermetallic compound is NiTi, the lattice defect is introduced in step (a) by rolling said intermetallic compound at room temperature, the heating of step (c) is conducted at a temperature in the range of 255° to 273° K. and the electron beam is maintained for approximately 1300 seconds.

3. The method as claimed in claim 1, wherein the intermetallic compound is NiTi, the lattice defect is introduced in step (a) by annealing said intermetallic compound at approximately 1,173° K. for about 12 KS, the heating of step (c) is conducted at a temperature of approximately 260° K. and the electron beam is maintained for approximately 1300 seconds.

4. The method as claimed in claim 1, wherein the intermetallic compound is $Co_2Ti$, the lattice defect is introduced in step (a) by annealing said intermetallic compound at approximately 1273° K. for about 160 KS, the irradiating of said intermetallic compound in step (a) is conducted with an electron beam having a flux density of approximately $1\times10^{24}$ e/m$^2$. sec, the heating of step (c) is conducted at a temperature of approximately 160° K. and the electron beam is maintained for approximately 120 seconds.

5. The method as claimed in claim 1, wherein said lattice defect is introduced in step (a) into said intermetallic compound at said predetermined position by a method selected from the group consisting of plastic deformation, heat treatment and irradiation with a particle ray.

* * * * *